US007573437B2

(12) United States Patent
Nicolae

(10) Patent No.: US 7,573,437 B2
(45) **Date of Patent: *Aug. 11, 2009**

(54) SYSTEM AND METHOD FOR A RADIO-ANTENNA INTERFACE

(75) Inventor: Costel Nicolae, Dollard-des-Ormeaux (CA)

(73) Assignee: Harris Stratex Networks, Inc., Morrisville, NC (US)

( * ) Notice: Subject to any disclaimer, the term of this patent is extended or adjusted under 35 U.S.C. 154(b) by 77 days.

This patent is subject to a terminal disclaimer.

(21) Appl. No.: 11/690,769

(22) Filed: Mar. 23, 2007

(65) Prior Publication Data

US 2008/0106486 A1 May 8, 2008

Related U.S. Application Data

(63) Continuation of application No. 10/879,637, filed on Jun. 30, 2004, now Pat. No. 7,212,172.

(51) Int. Cl.
*H01Q 1/24* (2006.01)

(52) U.S. Cl. ..... 343/878; 343/906

(58) Field of Classification Search ..... 343/840, 343/878, 905, 906, 915, 916
See application file for complete search history.

(56) References Cited

U.S. PATENT DOCUMENTS

| | | | | |
|---|---|---|---|---|
| 5,969,692 | A | 10/1999 | Ishizuka | |
| 6,507,324 | B2 | 1/2003 | Overton et al. | |
| 6,685,383 | B2 | 2/2004 | Rosenfeld | |
| 7,212,172 | B2 * | 5/2007 | Nicolae | 343/878 |

* cited by examiner

*Primary Examiner*—Michael C Wimer
(74) *Attorney, Agent, or Firm*—Sheppard, Mullin, Richter & Hampton LLP

(57) ABSTRACT

A radio-antenna interface is disclosed for coupling of an antenna to one or more radio receivers. The radio-antenna interface includes a hub and a feed-boom. The hub includes an aperture adapted to receive the feed-boom. The hub is also fitted with latches adapted to detachably couple the radio to the hub in a manner which is substantially independent of a configuration type of the radio. The hub is adapted to be detachably coupled to the antenna in a manner which substantially avoids reconfiguration of the antenna. The feed-boom communicates signals received by the antenna to the radio.

30 Claims, 5 Drawing Sheets

SYSTEM AND METHOD FOR A RADIO-ANTENNA INTERFACE

REFERENCE TO EARLIER FILED APPLICATION

This application is a continuation of and hereby incorporates by reference U.S. patent application Ser. No. 10/879,637, filed on Jun. 30, 2004, entitled "SYSTEM AND METHOD FOR A RADIO/ANTENNA INTERFACE."

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

The radio and antenna are the core components of a wireless communication system. While in some instances the antenna can be placed remotely from the front-end reciever and/or radio, a more efficient configuration is attaching the radio directly to the antenna. For the latter case, specific antenna interfaces have been designed to accommodate the specific radio/antenna configurations.

Because industrial radios are typically manufactured by different manufacturers, combining the two units requires design modification. Presently, for each radio system design (i.e., unprotected, protected or protected with RF combiner) the antenna interface is configured differently based on the manufacturer's own requirements. These differences fail in situations where combining different units may be necessary. The problem is particularly pronounced where the end-user uses an existing antenna with a new radio system. Such situations require purchasing a supplemental antenna/radio interface kit (i.e., a special interface plate and feed-boom adaptor).

Another problem with the conventional devices is the incompatibility of the interface with the required application. For example, mounting systems have used lock tabs for fastening the radio to the antenna. Because of the nature of lock tabs and the ability to provide only a limited total compression per latch, these components have been ineffective for combinations that are exceedingly heavy or require exceptional interface security. Bolts, on the other hand, can provide greater compression loads but they require individual installation which necessitates retrofitting one or both of the radio and the antenna with appropriate fixtures for receiving the bolts. Because the antenna and the radio are typically manufactured by different entities, they typically do not include appropriate fixtures for receiving the bolts.

Finally, conventional mounting systems have failed to consider the necessary electrical connections for properly engaging the antenna, the feed-boom and the radio. Thus, there is a need for an antenna/radio interface that addresses these shortcomings.

SUMMARY

Accordingly, for the purposee of the invention as shown and broadly described herein the present invention is directed to a system and method for a radio-antenna interface. In accordance with one embodiment, a radio-antenna interface comprises a hub and a feed-boom. The hub includes an aperture and a plurality latches. The aperture is adapted to receive the feed-boom for communicating signals between an antenna and a radio. The hub is adapted to be detachably coupled to the antenna in a manner which substantially avoids reconfiguration of the antenna. Furthermore, the plurality of latches is adapted to detachably couple the radio to the hub in a manner which is substantially independent of the radio's configuration type.

In such radio-antenna interface, the hub may include an outer rim. The plurality of latches may be coupled to the outer rim. The plurality of latches may be disposed about a circumference of the outer rim. The fasteners may be coupled to the outer rim for coupling the hub to the antenna, to the radio, or both. Each of the fasteners may include a bolt to achieve compression load than any latch of the plurality of latches. The feed-boom received in the aperture may be rotatable. The feed-boom may be rotatable to enable meeting a predefined polarization. The plurality of latches may include a locking tab.

The radio-antenna interface may also include one or more clearance or threaded holes for coupling the hub to the radio. The radio-antenna interface may further include one or more apertures that allow manual maneuvering of the radio-antenna interface after coupling the hub to the radio. The hub may also include an inner rim for detachably coupling the hub to the feed-boom. The hub may further include a retainer ring for retaining the feed-boom in the aperture. The retainer ring may be configured to retain the feed boom during a polarization change maneuver. The radio-antenna interface may further include one or more apertures for use as a handle, for receiving a security chain, or both.

In accordance with another embodiment, an antenna assembly flit receiving a radio comprises an antenna and a radio interface. The radio interface includes a hub and a feed-boom. The hub is coupled to the antenna and includes an aperture and a plurality of latches. The aperture is adapted to receive the feed-boom for communicating signals between the antenna and a radio. The plurality or latches is adapted to detachably couple the radio to the hub in a manner which is substantially independent of the radio's configuration type.

In such antenna assembly, the hub may be adapted to be interchangeably detachably coupled to a replacement radio independent of the feed-boom and the antenna. The antenna assembly may further include means for securing an assembly to a post, a column or wall. That assembly may include the antenna, the radio interface, and the radio.

In accordance with yet another embodiment, a method for detachably coupling a radio and an antenna to a radio-antenna interface comprises providing a hub including an aperture and a plurality of latches, receiving, at the aperture, a feed-boom for communicating signals between the antenna and the radio. The method further comprises detachably coupling the hub to the antenna in a manner which substantially avoids reconfiguration of the antenna, and coupling the plurality of latches to the radio to detachably couple the radio to the hub in a manner which is substantially independent of a radio configuration type. Such method may further include rotating the feed-boom in order to perform a polarization change maneuver.

In these embodiments, various possible attributes may be present. The radio may be configured as an unprotected radio, a protected radio, or a radio frequency (RF) combiner. The radio may be detached from the hub without decoupling the antenna. The antenna may be detached from hub without decoupling the radio. The antenna may have parabolic antenna configuration.

DETAILED DESCRIPTION OF THE DISCLOSURE

In accordance with the principles disclosed herein a radio/antenna interface is disclosed which can be used independent of the radio type or configuration. In one embodiment, different types of radios and RF combiners can be detachably coupled to an antenna to form the desired combination. Another embodiment is directed to an antenna body fitted with a radio interface adapted to receive different radio system types. In still another embodiment, a radio/antenna interface is disclosed which can be used to combine the radio with the antenna with minimum reconfiguration and/or design modification. In still another embodiment, a radio/antenna interface is disclosed that can accommodate a plurality of radios interfacing with one antenna.

Figure 1B:
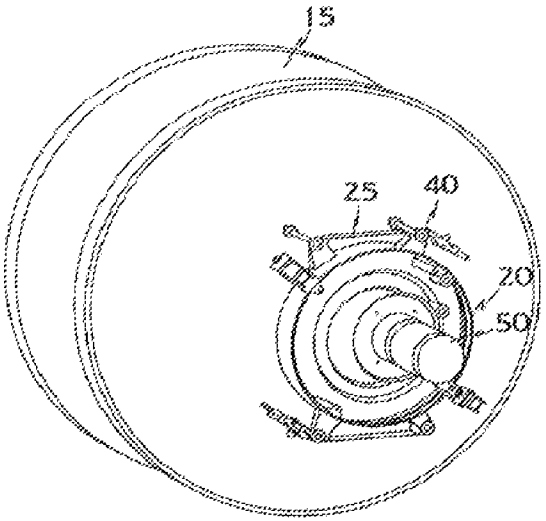
FIG. 1B is a schematic illustration of FIG. 1A in the assembled state.
Figure 1A:
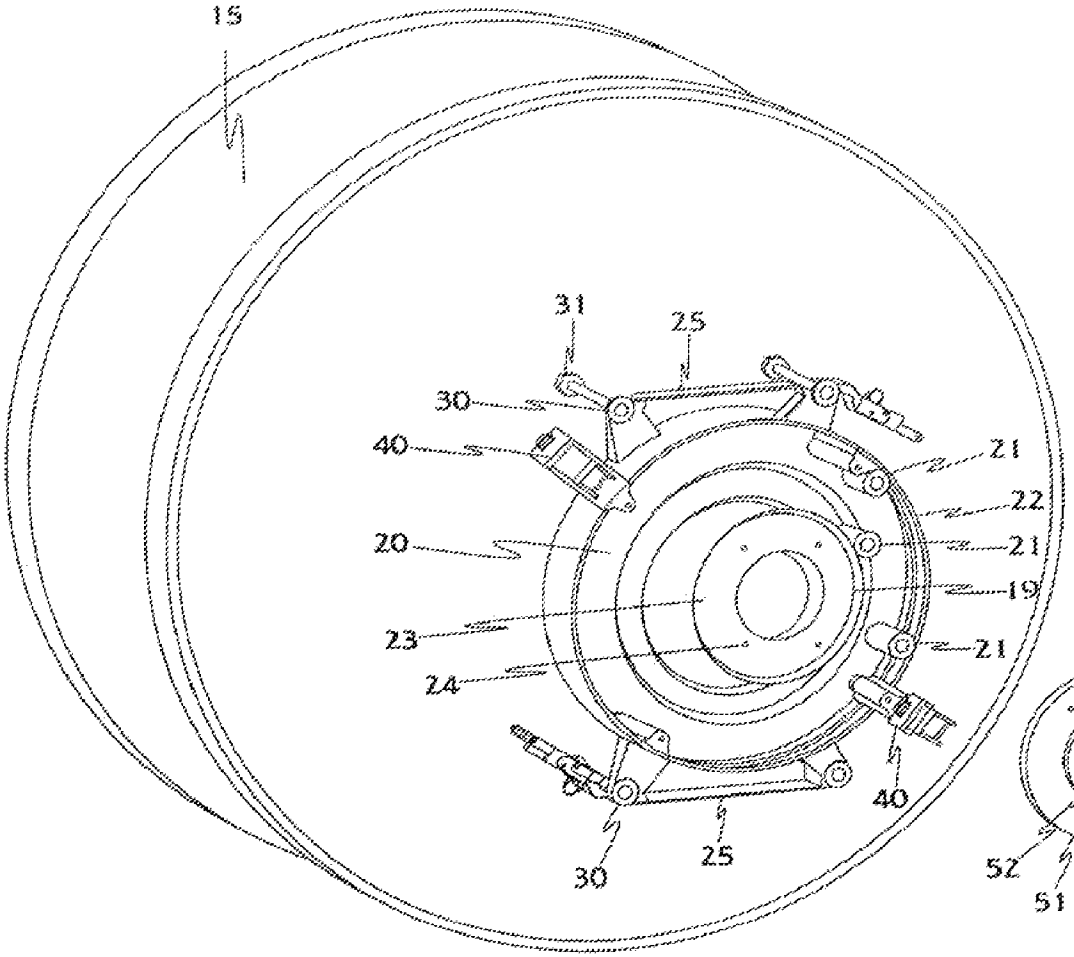
FIG. 1A is a schematic illustration of an antenna, a hub and a feed-boom in an unassembled state.

FIG. 1A is a schematic illustration of an antenna, a hub and a feed-boom in an unassembled state. With reference to FIG. 1, antenna 15, which can be a parabolic antenna, is shown to have mounted thereon hub 20. According to one embodiment, hub 20 provides an interface between antenna 15 and a radio transceiver (the terms radio and transceivers are used interchangeably herein.) To mount hub 20 is attached to the antenna 15 with fasteners (not shown).

Antenna 15 can include any conventional parabolic, circular or the so-called hub-ring antenna and is not limited to the parabolic antenna illustrated herein. The hub-ring may be attached also, to a flat panel antenna.

Hub 20 includes handles 25 on each end, that have incorporated clearance holes 30 to receive screws 31. The handle or other type of aperture is to be used during the transport or to lift the antenna or/and prevent from accidentally dropping of the radios/RF Combiner by attaching a security chain during installation. The latches 40 may be optionally installed on hub 20 with equal spacing therebetween. Alternatively, one or more latch 40 can be installed strategically to receive a particular radio system configuration. Latch 40 can have a locking tab or similar configuration to enable quick mounting (i.e., quick-release tab) and dismounting of the radio. Additional bosses 21 are provided on hub 20 for pole mounting bracket assembly. Each boss may be internally (or optionally, externally) threaded to receive a fastener screw.

In the embodiment of FIG. 1A, aperture 23 is provided at the center of hub 20 to receive feed-boom 50. Aperture 23 is fitted with threaded holes 24 for receiving screws that engage feed-boom 50. In one embodiment, screws 57 pass thru clearance holes 52 to engage feed-boom 50 to hub 20. Retainer ring 56 can be optionally used to keep captured the feed-boom during the polarization change maneuver. As shown in FIG. 1, aperture 23 can be devised to include a rim-type edge 19 for receiving feed-boom 50. The rim can be specifically devised to house at least a portion of feed-boom 50 by receiving bottom edge 51. Thus, if unlike the exemplary embodiment of FIG. 1, feed-boom 50 is rectangular, aperture 23 can be adapted to have a rectangular rim.

In another embodiment of the disclosure, feed-boom 50 is secured to common hub 20 with fasteners that enable rotation of the feed-boom in order to meet the desired polarization.

As is known to one of ordinary skill in the art feed-boom 50 communicates the signals received by antenna 15 to the radio. Similarly, feed-boom 50 communicates signals generated by a radio to antenna 15. The shape of feed-boom 50, in particular, knob 55 is dictated by the type (or wavelength) of the received signals. Various signal frequencies may demand different knob sizes and a different feed-boom shape. Thus, the shape of aperture 23 can be adapted to accommodate the appropriate feed-boom size and configuration.

Although not shown in FIG. 1A, hub 20 can be adapted to include extension bars or other type of brackets allowing the antenna/radio combination to be mounted to a post or a column or a wall so as to allow the combination to be suspended above ground and in a position to receive electromagnetic signals.

FIG. 1B is a schematic illustration of FIG. 1A in the assembled state. In the embodiment of FIG. 1B, feed-boom 50 is coupled to hub 20, and ultimately, to antenna 15. While the schematic illustrations of FIGS. 1A and 1B show the feed-boom engaging the antenna using flathead screws 57, the principles of the disclosure should not be limited thereto and, permutation of and deviation from, this embodiment are considered to be well within the scope of the disclosure.

Figure 2B:
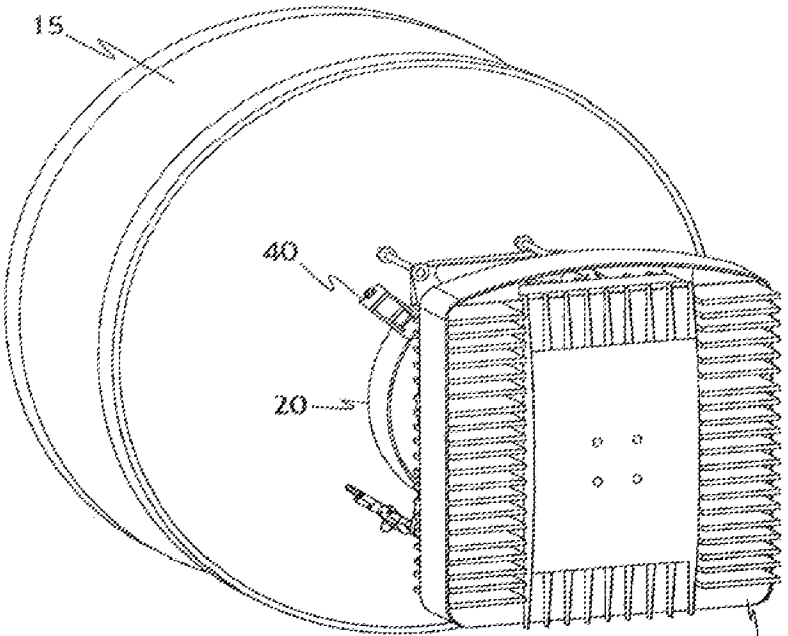
FIG. 2B schematically illustrates devices of FIG. 2A assembled.
Figure 2A:
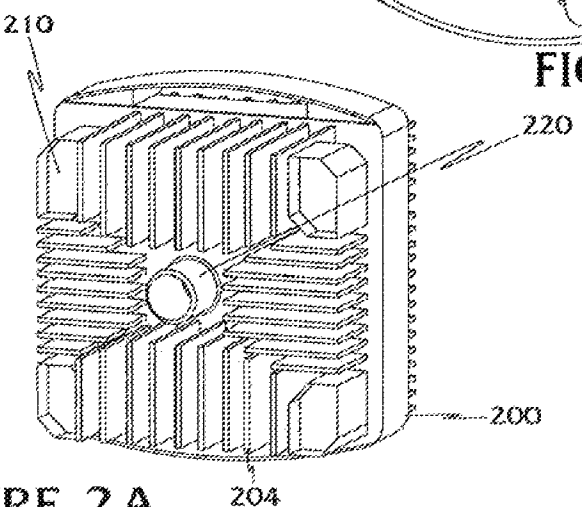
FIG. 2A schematically illustrates antenna and hub with an unprotected radio in an unassembled state.
Figure 2A:
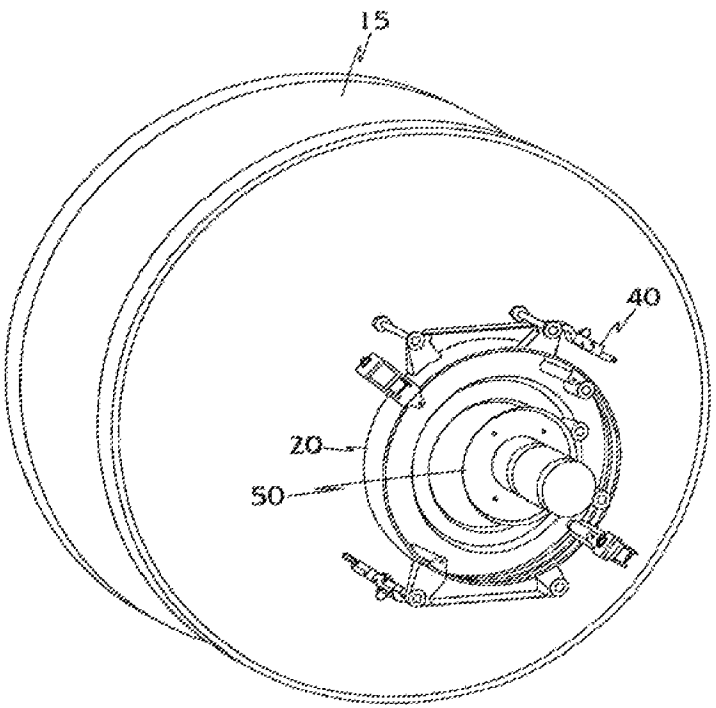

FIG. 2A schematically illustrates antenna and hub with an unprotected radio in an unassembled state. Referring to FIG. 2A, antenna 15 has the feed-boom 50 engaged through hub 20. Radio 200 is shown as having latch keepers 210, fins 204 and feed-boom receptacle 220. Fins 204 can be optionally provided to enhance heat dissipation but are not required to practice the principles of the disclosure. Latch keepers 210 of radio 200 work in conjunction with latches 40 of hub 20 and enable the coupling of radio 200 to antenna 15.

Receptacle 200 is specifically provided to receive feed-boom 50 thereby enabling signal communication between antenna 15 and radio 200. The inventive concept disclosed herein enables assembly of radio 200 to antenna 15 without substantial design modification to antenna 15 or radio 200. Moreover, these concepts provide for quick and easy assembly/disassembly of radio and antenna.

FIG. 2B schematically illustrates devices of FIG. 2A assembled. In the embodiment of FIG. 2B, radio 200 is coupled to antenna 15 by sliding the radio receptacle 220 on antenna feed-boom 50 and engaging latches 40 to radio keepers 210. While not shown in FIG. 2B, receptacle 220 is now fully engaged with the feed-boom (not shown in FIG. 2B)

such that signals received/transmitted by antenna 15 are readily communicated to radio 200.

The exemplary radio shown in FIGS. 2A and 2B can be considered as an unprotected radio. An unprotected radio is distinguished from a protected radio in that the latter typically comprises a backup radio system and an automated switch for switching between the active radio and the backup radio upon failure detection at the active radio. Consequently, a protected radio can be heavier and more bulky than an unprotected radio.

Figure 3B:
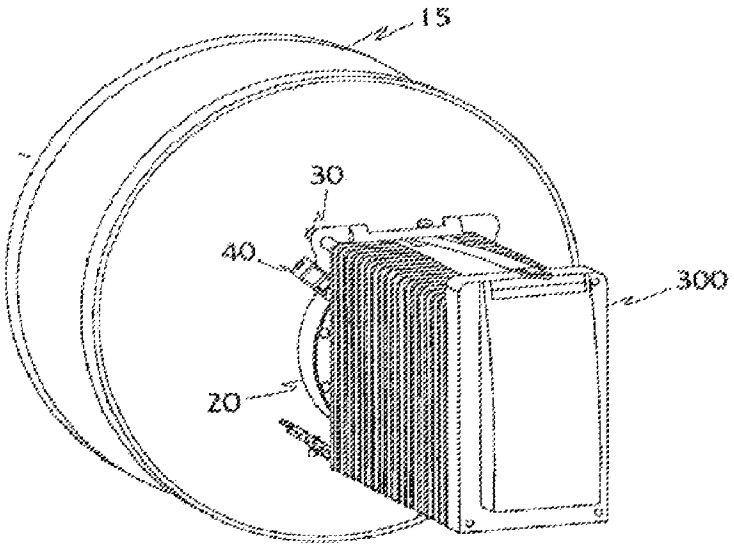
FIG. 3B schematically illustrates an assembled protected radio with antenna.
Figure 3A:
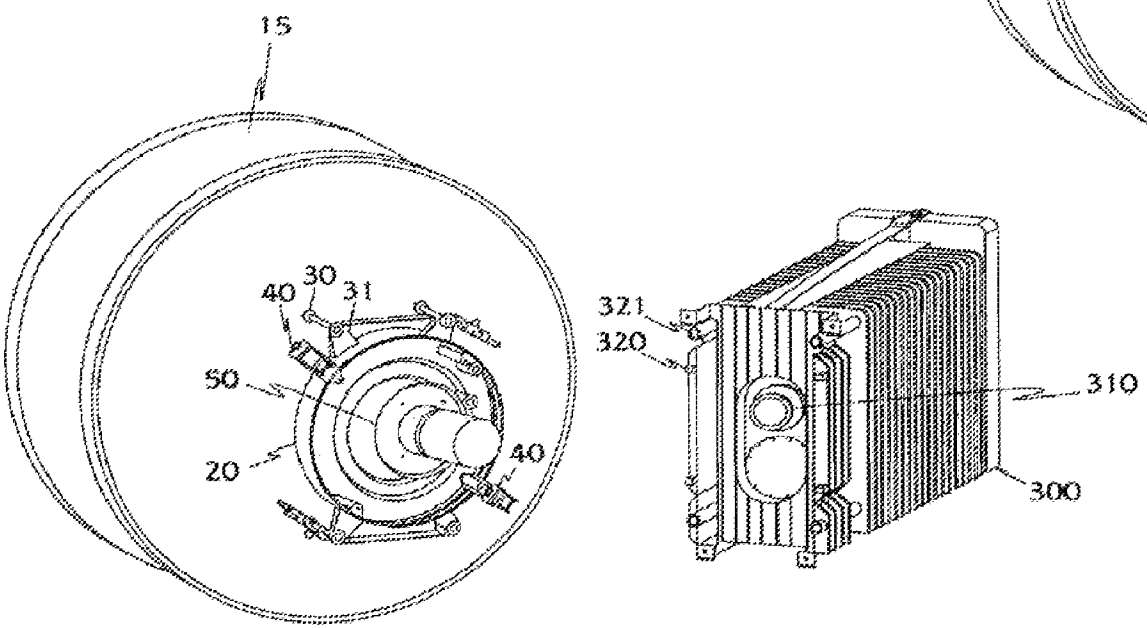
FIG. 3A schematically illustrates an unassembled protected radio with an antenna/hub assembly.

FIG. 3A schematically illustrates an unassembled protected radio with an antenna/hub assembly. The unassembled state of FIG. 3A shows hub 20 attached to antenna 15 by fasteners (not shown). Feed-boom 50 is positioned in hub 20 as disclosed in relation with FIGS. 1A and 2A. Protected radio 300 is shown with latch keepers 320 corresponding to latches 40 of hub 20. Because protected radio 300 can be substantially heavier than a comparable unprotected radio (e.g., radio 200 in FIG. 2B), hub 20 may be fitted with clearance holes 31 for receiving fasteners 30. These bolts are screwed in housing 321 to rigidly mount protected radio 300 to antenna 15. Receptacle 310 is positioned in protected radio 300 and slide on the antenna feed-boom 50 to communicate received signals from antenna 15 to the radio or to communicate signals from radio 300 to antenna 15 for broadcasting.

FIG. 3B schematically illustrates an assembled protected radio with antenna. As shown, protected radio 300 with receptacle 310 is engaged on the antenna 15 through the feed-boom 50 and attached with a combination of latches 40 and keepers 320. The additional fasteners 30 (e.g., screws) screwed on radio bosses 21 enable a more secure coupling of the radio 300 to antenna 15. This embodiment is particularly suitable for heavy radio and/or antenna combinations. The hub may be formed from aluminum or other compatible material.

Figure 4B:
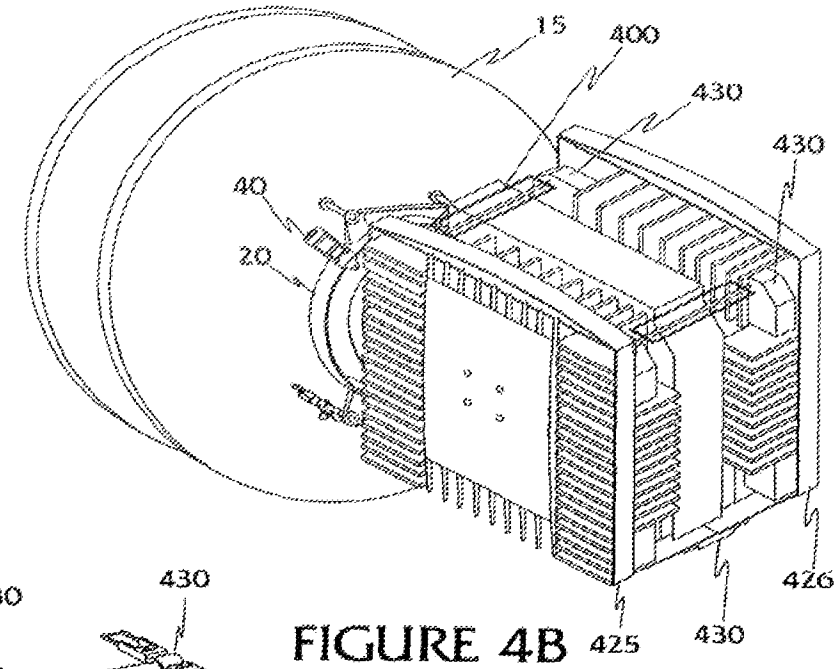
FIG. 4B shows the RF combiner of FIG. 4A and two unprotected radios assembled with the antenna.
Figure 4A:
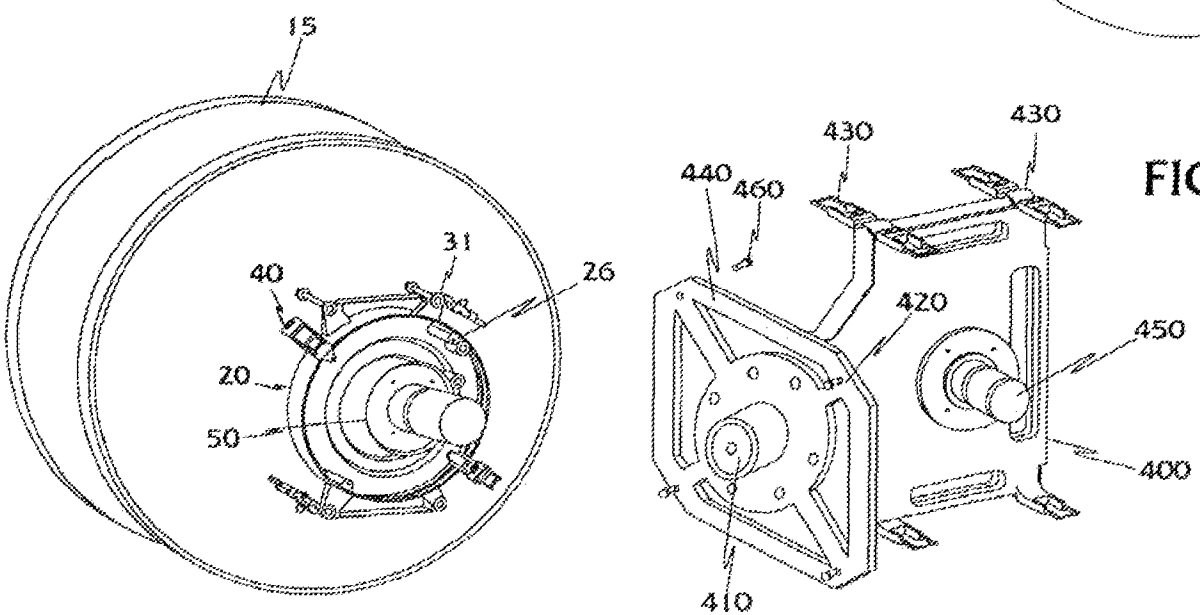
FIG. 4A shows an unassembled RF combiner with an antenna according to another embodiment of the disclosure.

FIG. 4A shows an unassembled RF combiner with an antenna according to another embodiment of the disclosure. The unassembled state of FIG. 4A shows hub 20 attached to antenna 15 by fasteners (not shown). Feed-boom 50 is positioned in hub 20 as disclosed in relation with FIGS. 1A and 2A. RF combiner 400 is shown to have an antenna interface plate 440 with a receptacle 410 for receiving feed-boom 50, latch keepers 420 for engaging latches 40 and captive screws 460. Also, the RF Combiner main body has latches 430 and feed-booms 450 for engaging unprotected radios. Receptacle 410 is devised to engage feed-boom 50 and relate signals from feed-boom 50 simultaneously to a plurality of radios. Thus, once assembled each radio can communicate with antenna 15 through auxiliary feed-booms 450 (a second auxiliary feed-boom 450 is positioned on the opposite side of the first auxiliary feed-boom and is not shown in FIG. 4A.) Although shown with only two radios, the embodiment of FIG. 4A can be extended to secure a more than two radios to an antenna. The RF Combiner 400 is rigidly coupled to the antenna 15 by using the fasteners 460 screwed on the threaded holes 26 provided on hub 20. This embodiment is particularly suitable for heavy RF Combiner/radios and/or antenna combinations.

FIG. 4B shows the RF combiner of FIG. 4A and two unprotected radios assembled with antenna 15. As shown, unprotected radios 425 and 426 are secured by latches 430 to RF combiner 400. It is noted that various securing means can be used to secure unprotected radios 425 and 426 to RF combiner 400 according to the principles of the disclosure. In FIG. 4B the hub 20 is coupled with the RF Combiner 400 through latches 40 and fastening means not show; both unprotected radios 425 and 426 are engaged with the auxiliary RF Combiner feed-booms and attached with latches 430.

Figure 5A:
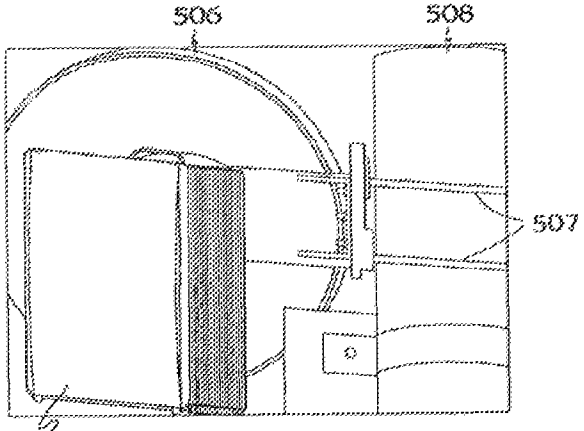
FIGURE 5A (PRIOR ART)
FIG. 5A shows a detachable protected radio coupled to an antenna according to one embodiment of the disclosure.

FIG. 5A shows a conventional detachable protected radio coupled to an antenna according to one embodiment of the disclosure. Specifically, FIG. 5A shows Microstar M radio 505 (manufactured by Harris Corporation) attached to antenna 506 (F03 type antenna). The entire assembly is mounted to post 508 through mounting bracket 507. Mounting bracket 507 can be integrated with a hub or can be provided to removably engage a hub.

Figure 5B:
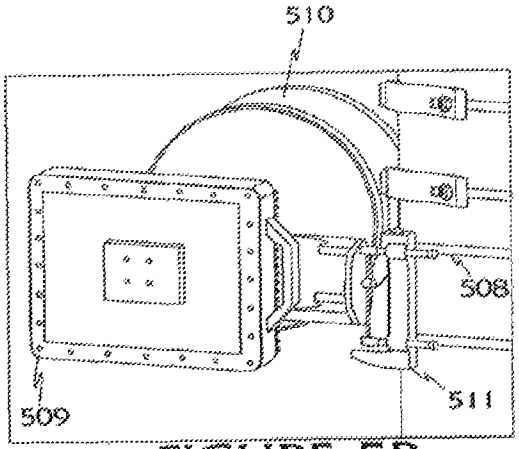
FIGURE 5B (PRIOR ART)
FIG. 5B shows a detachable unprotected radio coupled to an antenna in accordance with another embodiment of the disclosure.

FIG. 5B shows a conventional detachable unprotected radio coupled to an antenna in accordance with another embodiment of the disclosure. In FIG. 5B, Microstar M/H radio 509 (manufactured by Harris Corporation) is coupled to F04 type antenna 510 by a hub assembly (not shown). The hub assembly is provided with mounting bracket 511 that enable mounting the assembly to post 508.

Figure 5C:
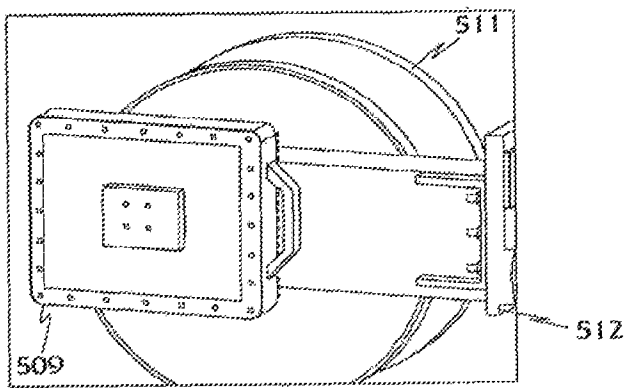
FIGURE 5C (PRIOR ART)
FIG. 5C shows an unprotected radio coupled to an antenna by using an interface plate kit according to one embodiment of the disclosure.

FIG. 5C shows a conventional interface plate kit coupling an antenna 511 with a radio according to one embodiment of the disclosure. Specifically, FIG. 5C shows Microstar M/H radio (509) with F03 type antenna using an adapter interface plate kit (511). The interface plate kit 511 is an integrated hub and extension. While not shown, the hub can have a structure consistent with the principles of the disclosure and have an extension portion adapted for mounting.

Figure 5D:
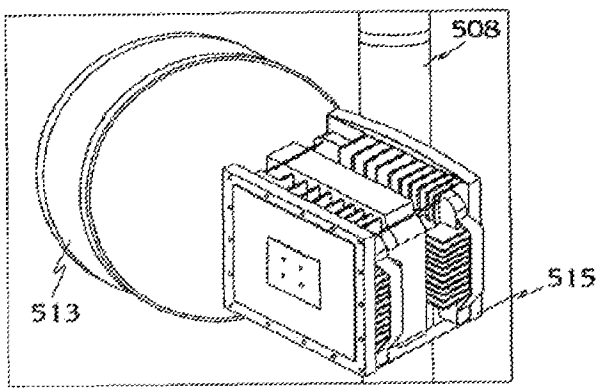
FIGURE 5D (PRIOR ART)
FIG. 5D shows a protected radio system (one RF Combiner and two unprotected radios) coupled to an antenna using an interconnect according to another embodiment of the disclosure.

FIG. 5D shows a conventional protected radio system (one RF Combiner and two unprotected radios) coupled to an antenna using an interconnect according to another embodiment of the disclosure. In particular, FIG. 5D shows two unprotected Microstar M/H radios and RF combiner assembly 515 coupled to parabolic antenna (type F05 or F06) 513 and mounted to post 508.

Thus, FIGS. 5A-5D show the that prior art configurations require different radios to be installed on different specific antennas. The principles disclosed herein enable replacing various antennas (F03, F04, F05, F06) and eliminates the previous adapter interface plate kit by a common antenna (see, e.g., FIG. 1). The antenna may have a common hub to provide all the necessary features to allow the connection with various radio configurations; namely, unprotected radio, protected radio and RF combiner.

It is noted that while the embodiment of the disclosure are described in relation to the exemplary embodiments provided herein, the disclosure is not limited thereto and includes any permutation and modification of the principles disclosed herein.

What is claimed is:

1. A radio-antenna interface, comprising:

a hub including an aperture and a plurality of latches; and a feed-boom, wherein the aperture is adapted to receive the feed-boom for communicating signals between an antenna and a radio, wherein the hub is adapted to be detachably coupled to the antenna in a manner which substantially avoids reconfiguration of the antenna, and wherein the plurality of latches is adapted to detachably couple the radio to the hub in a manner which is substantially independent of the radio's configuration type.

2. A radio-antenna interface as in claim 1, wherein the radio is detachable from the hub without decoupling the antenna.

3. A radio-antenna interface as in claim 1, wherein the antenna is detachable from the hub without decoupling the radio.

4. A radio-antenna interface as in claim 1, wherein the hub includes an outer rim and wherein the plurality of latches is coupled to the outer rim.

5. A radio-antenna interface as in claim 1, wherein the hub includes an outer rim and wherein the plurality of latches is disposed about a circumference of the outer rim.

6. A radio-antenna interface as in claim 1, wherein the hub includes an outer rim and fasteners coupled to the outer rim for coupling the hub to the antenna.

7. A radio-antenna interface as in claim 6, wherein each of the fasteners includes a bolt to achieve a higher compression load than any latch of the plurality of latches.

8. A radio-antenna interface as in claim 1, wherein the feed-boom received in the aperture is rotatable.

9. A radio-antenna interface as in claim 8, wherein the feed-boom is rotatable to enable meeting a predefined polarization.

10. A radio-antenna interface as in claim 1, wherein the hub includes an outer rim and fasteners coupled to the outer rim for coupling the hub to the radio.

11. A radio-antenna interface as in claim 10, wherein each of the fasteners includes a bolt to achieve a higher compression load than any latch of the plurality of latches.

12. A radio-antenna interface as in claim 1, further comprising one or more clearance or threaded holes for coupling the hub to the radio.

13. A radio-antenna interface as in claim 1, further comprising one or more apertures that allow manual maneuvering of the radio-antenna interface after coupling the hub to the radio.

14. A radio-antenna interface as in claim 1, wherein the radio is configured as an unprotected radio, a protected radio, or a radio frequency (RF) combiner.

15. A radio-antenna interface as in claim 1, wherein the antenna has a parabolic antenna configuration.

16. A radio-antenna interface as in claim 1, wherein the hub further comprises an inner rim for detachably coupling the hub to the feed-boom.

17. A radio-antenna interface as in claim 1, wherein the hub further comprises a retainer ring for retaining the feed-boom in the aperture.

18. A radio-antenna interface as in claim 17, wherein the retainer ring is configured to retain the feed-boom during a polarization change maneuver.

19. A radio-antenna interface as in claim 1, wherein the plurality of latches includes a locking tab.

20. A radio-antenna interface as in claim 1, further comprising one or more apertures for use as a handle.

21. A radio-antenna interface as in claim 1, further comprising one or more apertures for receiving a security chain.

22. An antenna assembly for receiving a radio, comprising:

an antenna; and a radio interface including a hub coupled to the antenna and including an aperture and a plurality of latches, and a feed-boom, wherein the aperture is adapted to receive the feed-boom for communicating signals between the antenna and a radio, and wherein the plurality of latches is adapted to detachably couple the radio to the hub in a manner which is substantially independent of the radio's configuration type.

23. An antenna assembly as in claim 22, wherein the radio can be detached from the hub without decoupling the antenna.

24. An antenna assembly as in claim 22, wherein the hub is adapted to be interchangeably detachably coupled to a replacement radio independent of the feed-boom and the antenna.

25. An antenna assembly as in claim 22, wherein the radio is configured as an unprotected radio, a protected radio, or a radio frequency (RF) combiner.

26. An antenna assembly as in claim 22, further comprising means for securing an assembly including the antenna, the radio interface, and the radio to a post, a column or a wall.

27. A method for detachably coupling a radio and an antenna to a radio-antenna interface, comprising:

providing a hub including an aperture and a plurality of latches;

receiving, at the aperture, a feed-boom for communicating signals between the antenna and the radio;

detachably coupling the hub to the antenna in a manner which substantially avoids reconfiguration of the antenna; and coupling the plurality of latches to the radio to detachably couple the radio to the hub in a manner which is substantially independent of the radio's configuration type.

28. A method as in claim 27, further comprising detaching the radio from the hub without decoupling the antenna.

29. A method as in claim 27, further comprising detaching the antenna from the hub without decoupling the radio.

30. A method as in claim 27, further comprising rotating the feed-boom in order to perform a polarization change maneuver.

* * * * *